US005557165A

United States Patent [19]

Descombes et al.

[11] Patent Number: 5,557,165

[45] Date of Patent: Sep. 17, 1996

[54] DEFLECTION YOKE ATTACHMENT ARRANGEMENT

[75] Inventors: Jean-Philippe Descombes, Premiéres; Alain Vougny, Dijon, both of France

[73] Assignee: Thomson Tubes & Displays, S.A., France

[21] Appl. No.: 465,025

[22] Filed: Jun. 5, 1995

[30] Foreign Application Priority Data

Jan. 7, 1994 [EP] European Pat. Off. ..... 94401502

[51] Int. Cl.[6] ..... H01J 29/70

[52] U.S. Cl. ..... 313/440; 335/210; 335/213; 348/829

[58] Field of Search ..... 313/440; 335/213, 335/210, 296; 348/829, 830, 833

[56] References Cited

U.S. PATENT DOCUMENTS

| | | | |
|---|---|---|---|
| 2,692,355 | 10/1954 | Sickles et al. | 313/440 X |
| 4,143,346 | 3/1979 | Borkar et al. | 335/210 X |
| 4,206,481 | 6/1980 | Imahashi et al. | 358/248 |
| 4,338,584 | 7/1982 | Howard | 335/210 |
| 4,786,838 | 11/1988 | Meershoek et al. | 313/440 |
| 4,841,267 | 6/1989 | Watabe et al. | 335/213 X |
| 5,028,898 | 7/1991 | Tsukii et al. | 335/210 |
| 5,150,003 | 9/1992 | Shin | 313/440 |
| 5,191,253 | 3/1993 | Kang | 335/201 X |
| 5,258,734 | 11/1993 | Tamai et al. | 335/210 X |

FOREIGN PATENT DOCUMENTS

| | | |
|---|---|---|
| 0241057 | 10/1987 | European Pat. Off. . |
| 1107347 | 5/1961 | Germany . |
| 2250631 | 6/1992 | United Kingdom . |

OTHER PUBLICATIONS

IBM Technical Disclosure Bulletin, vol. 24, No. 5, Oct. 1981, pp. 2223–2224, "Low Capacitance Stator CRT Deflection Yoke" by Brownell, et al.

RCA 87,690 entitled An Auxiliary Coil Fastener In A Deflection Yoke, inventors: Alain Dossot, Christophe Mathey and Alain Vougny filed concurrently herewith.

RCA 87,692 entitled A Deflection Yoke Liner With Support Ridges, inventors: Jean–Philippe Descombes, Philippe Marotte, filed concurrently herewith.

*Primary Examiner*—Sandra L. O'Shea
*Assistant Examiner*—Ashok Patel
*Attorney, Agent, or Firm*—Joseph S. Tripoli; Joseph J. Laks; Sammy S. Henig

[57] ABSTRACT

A deflection yoke for a cathode ray tube includes a pair of saddle-shaped horizontal deflection coils, a pair of saddle-shaped vertical deflection coils separated from the horizontal deflection coils by a rigid separator. The separator is formed from a funnel-shaped main body and a removable rear ring. The rear ring has an arrangement for locking to the main body and partially covers the back of the vertical deflection coils. Arms are placed around an external periphery of the rear ring that extend towards a core made of magnetic material. The core is placed around the vertical coils. The arms hold the core in place.

11 Claims, 4 Drawing Sheets

DEFLECTION YOKE ATTACHMENT ARRANGEMENT

BACKGROUND OF THE INVENTION

This invention relates to a deflection yoke for a cathode ray tube.

Generally, a deflection yoke includes a pair of vertical deflection coils, a pair of horizontal deflection coils, a truncated cone made of magnetic material for enhancing a flux created by the coils and a separator or liner. The two pairs of deflection coils are separated from each other by the separator, generally made of plastic. The separator enhances the mechanical stiffness and fixes the coils with respect to one another. The separator includes a main body in the shape of a funnel and a flexible rear part adapted to surround the tube neck for attaching the deflection yoke onto the tube neck to establish the longitudinal position of the yoke. This attachment is generally made using a clamp collar placed around the rear flexible part.

In a saddle-saddle (S—S) yoke, the horizontal deflection coils are placed around an inside wall of the separator and are generally held in place by clipping and/or gluing. The vertical deflection coils are placed around an outside wall of the separator. The front part of the vertical deflection yoke may be attached by inserting it in a housing provided on the separator. The ring shaped core made of ferromagnetic material is placed around the vertical deflection coils and partially covers them.

The rear part of the vertical deflection coils is held in place so that the position of the core can be adjusted to provide convergence. After this adjustment has been made, the core is permanently attached. FIG. 1 illustrates a prior art deflection yoke 1 that includes a pair of saddle-shaped horizontal deflection coils 3, a pair of vertical deflection coils 4, also saddle-shaped, separated from horizontal deflection coils 3 by a separator 2. A core 5 made of magnetic material is placed around coils 3 and 4. Deflection yoke 1 is placed on a neck 8 of a cathode ray tube (CRT) 6 in order to provide deflection of electron beams from an electron gun 7. Consequently, a raster can be formed on a screen surface 9. The various elements used in yoke 1 can be held in an optimum adjustment position by gluing. Thus, separator 2 supports the various elements and provides the mechanical stiffness of the assembly. However, disadvantageously, support by gluing slows down the manufacturing process. This is so because core 5 can be positioned only after coils 4 have been permanently fixed in place. Moreover, supporting the rear part of coils 4 by gluing may not be reliable due to mechanical stresses applied to yoke 1 during adjustment when yoke 1 is placed on the tube neck.

Another prior art construction method is shown in FIG. 2. Similar symbols in FIGS. 1 and 2 indicate similar items or functions. In the yoke of FIG. 2, the vertical deflection coils and the core are held in position by means of a ring 13 that attaches onto rails 10 placed on a cylindrical part of separator 2. An elastic split ring 14 is used to attach the deflection yoke of FIG. 2 onto the tube neck using a clamping collar, not shown, placed around ring 14. Ring 13 slides on rails 10 until the vertical deflection coils, not shown, come into contact with the front of the separator. Ring 13 is glued for permanent attachment of the assembly. Ring 13 may be used for assembling torroidal type vertical deflection coils that are wound around a core made of magnetic material. In such a case, ring 13 mechanically supports both the vertical deflection coils and the core.

For saddle-shaped coils, such as shown in FIG. 1, coils 4 extends along the Z-axis over a length greater than the length of core 5. Thus, an arrangement such as shown in FIG. 2 may not be able to mechanically support core 5.

SUMMARY OF THE INVENTION

A separator, embodying an inventive feature, includes a funnel-shaped main body portion and a removable rear ring portion. The main body portion and the removable rear ring portion are provided with a locking arrangement for selectively attaching them together. The removable rear ring portion is provided with an arrangement for supporting the rear part of the vertical deflection coils.

A deflection yoke, embodying an aspect of the invention, includes a horizontal deflection coil and a saddle-shaped vertical deflection coil separated from the horizontal deflection coil. A truncated cone-shaped core is made of magnetic material placed around at least one of the deflection coils. A separator for separating the horizontal and vertical deflection coils is provided. The separator includes a funnel-shaped main body and a removable rear ring having a locking attachment arrangement. The locking arrangement is used for selectively attaching the main body to the removable ring when the deflection yoke is assembled. A second attachment arrangement is provided for attaching the rear ring to the tube neck.

DETAILED DESCRIPTION OF THE PREFERRED EMBODIMENTS

Figure 1:
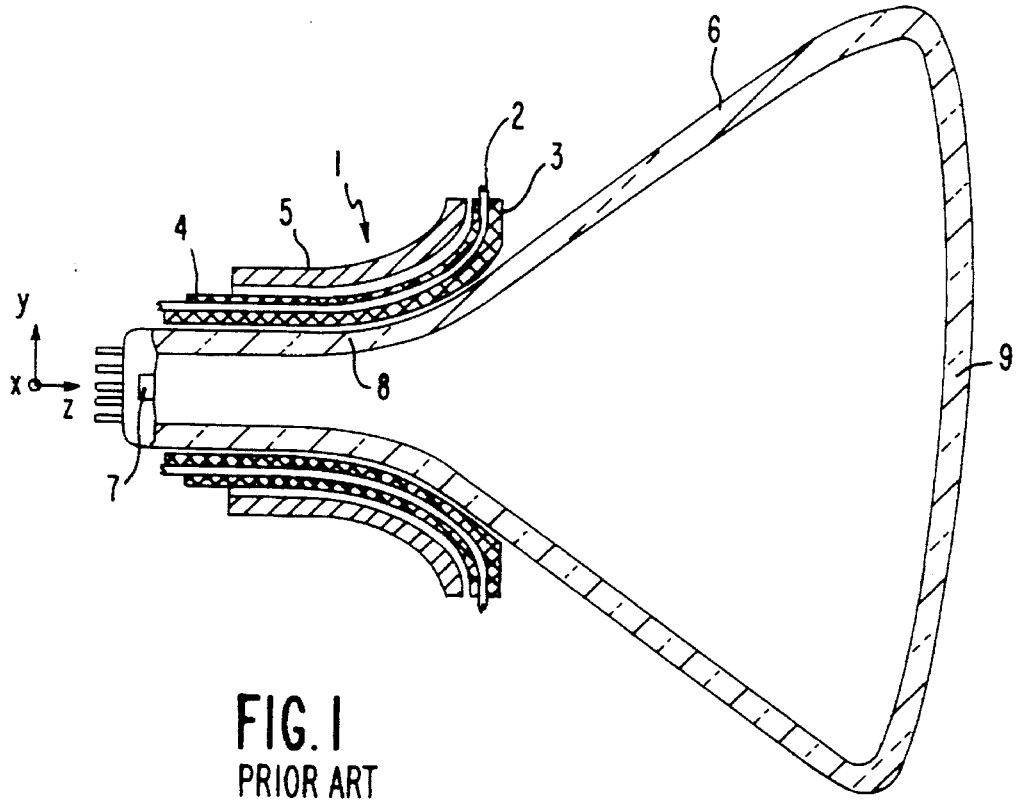
FIG. 1 PRIOR ART
FIGS. 1 and 2 illustrate prior art deflection yokes.
Figure 2:
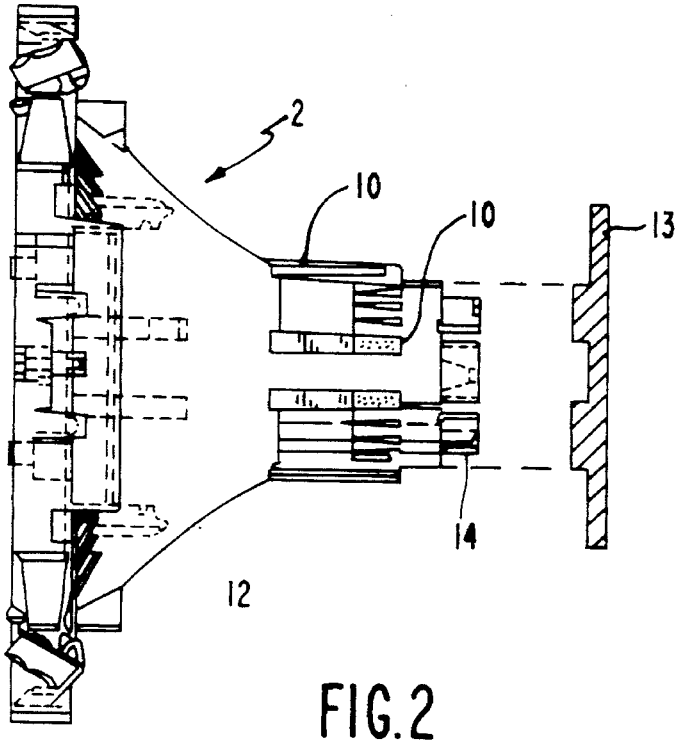
FIG. 2 PRIOR ART
Figure 3:
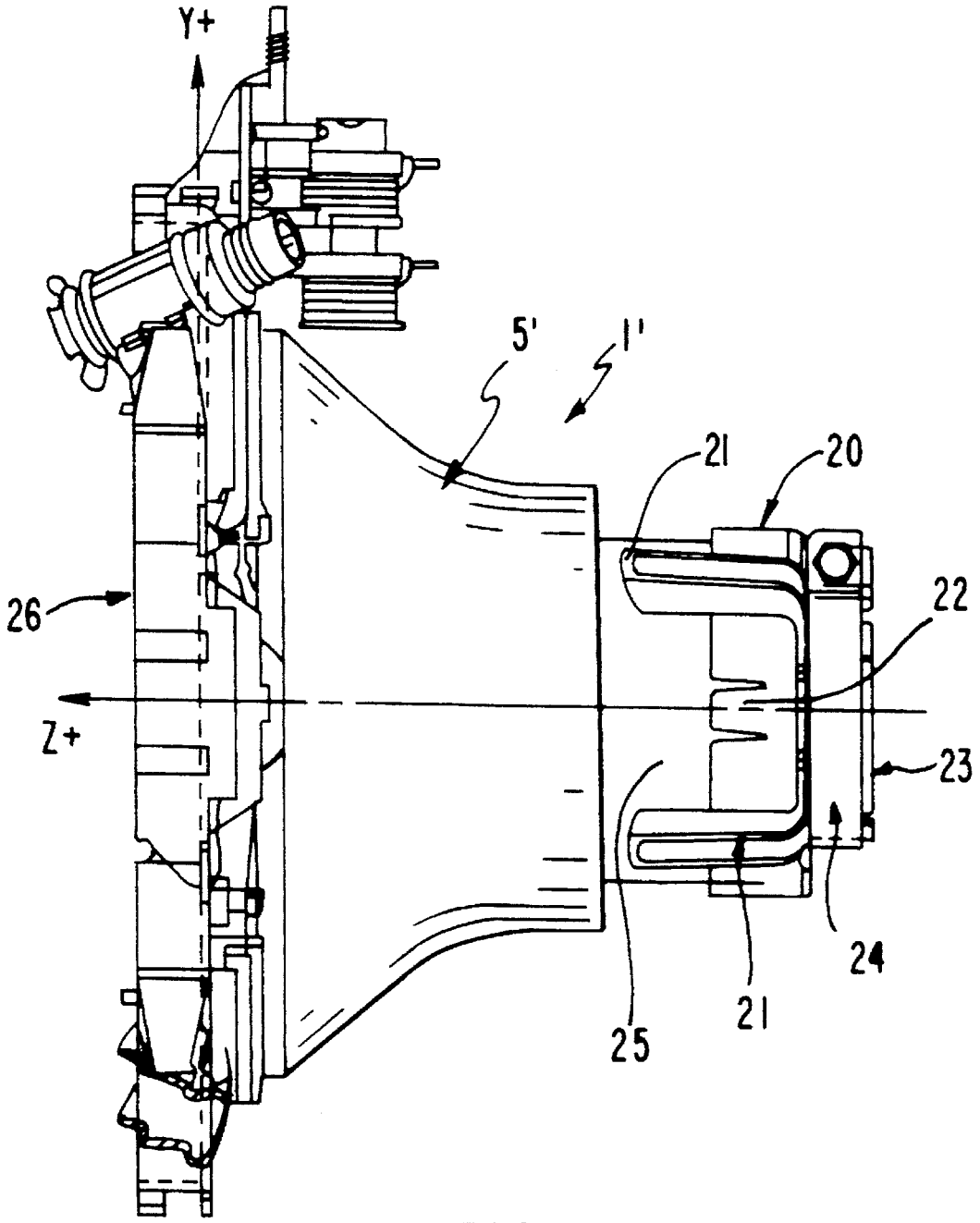
FIG. 3 illustrates a deflection yoke, embodying an inventive feature.

In FIG. 3, a separator, embodying an inventive feature, of a deflection yoke 1' includes a main body 26 and a rear part 20 that is selectively attached to body 26. Arms 21, embodying another inventive feature, extend from part 20 longitudinally towards a front of the deflection yoke in the direction of the arrow. Arms 21 extend almost up to a core 5' made of magnetic material. Flexible lugs 22 cover a rear part of a saddle shaped vertical deflection coils 25.

In carrying out a further inventive feature, flexible lugs 23 are formed around the periphery of part 20 at a region that is remote the furthest from the front of the separator. A clamping ring 24 surrounds lugs 23 for attachably securing deflection yoke 1' to the tube neck.

Figure 4:
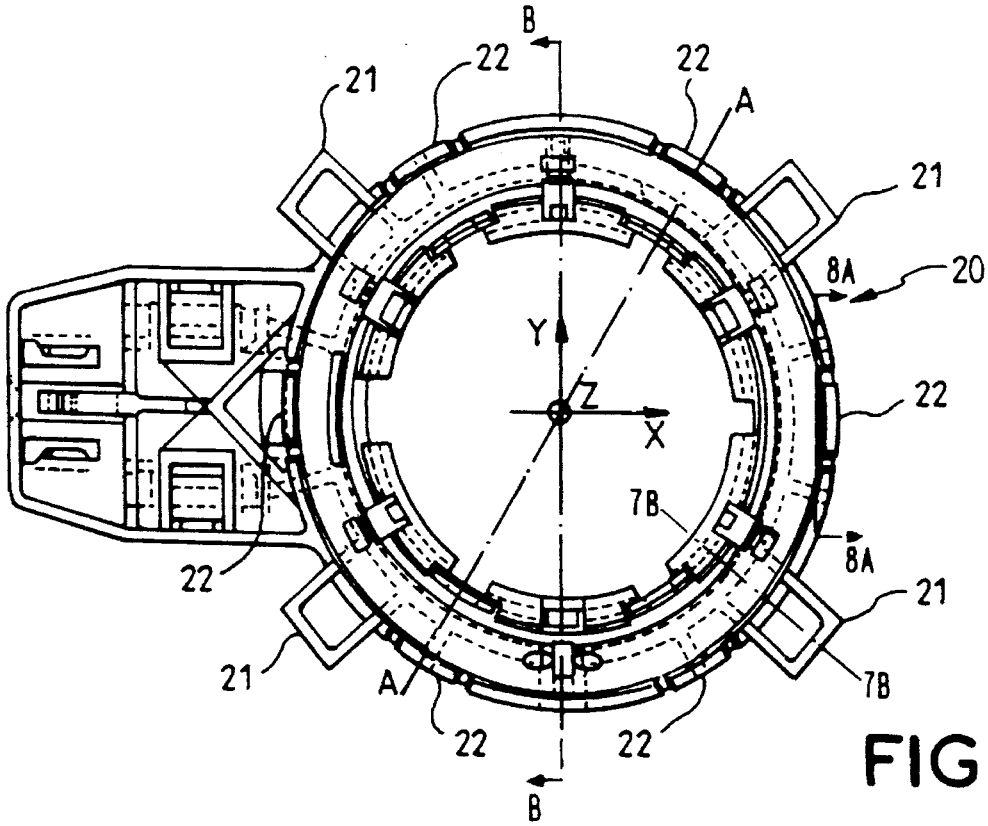
FIG. 4 illustrates a front view of a rear ring part of a separator of the yoke of FIG. 3 in the XY plane.
Figure 5:
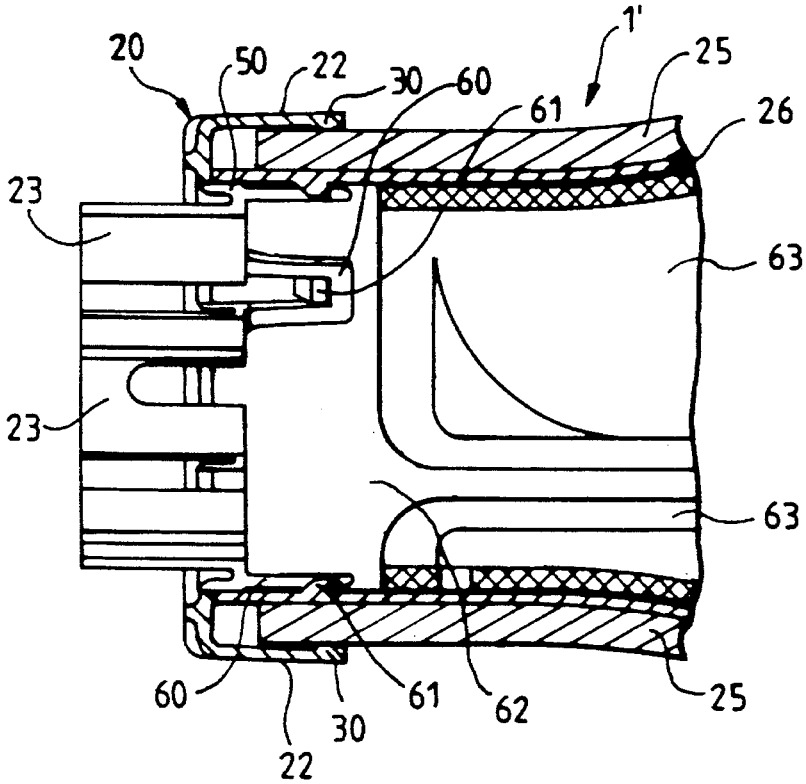
FIG. 5 illustrates a sectional view along line A—A of FIG. 4 in a plane containing the Z-axis of the assembled deflection yoke of FIG. 3.
Figure 6:
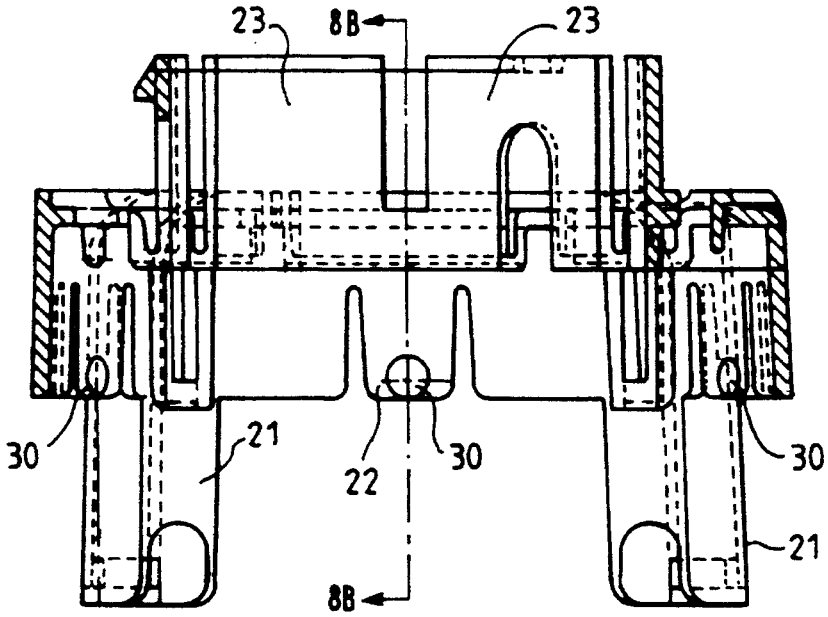
FIG. 6 illustrates a sectional view along line B—B in the YZ plane of the separator rear ring part of FIG. 4.

A front view of removable ring-shaped rear part 20 is as shown in FIG. 4. FIG. 5 shows a radial section of part 20, along line A—A of FIG. 4 passing through flexible lugs 22, when part 20 of FIG. 5 is attached to body 26. FIG. 6 illustrates a sectional view of rear part 20 in the XZ plane along line B—B of FIG. 4. Similar symbols and numerals in FIGS. 1–5 indicate similar items or functions.

As shown in FIG. 5, main body 26 and removable rear part 20 are attached to each other by flexible pawls 60 placed around an internal periphery of part 20 and extending towards the front of yoke 1'. Pawls 60 are equipped with openings that snap or latch onto studs 61 placed on an internal surface 62 of main body 26 of the separator. Studs 61 are placed such that the pawls 60 and studs 61 click fit together when rear part 22 is assembled with main body 26, thus providing for mechanical stiffness. In order to hold a rear part of a vertical deflection coil 25 of FIGS. 3 and 5 in place, flexible lugs 22 of FIGS. 3, 4 and 5 are placed around the external periphery of part 20. Lugs 22 partially cover the rear part of coil 25. Lugs 22 are spaced apart from pawls 60 in the radial direction.

Figure 8B:
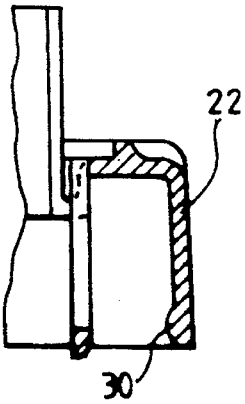
FIG. 8B illustrates a sectional view along line 8B—8B of FIG. 6 of an arrangement for supporting a rear part of vertical deflection coils of the yoke of FIG. 3.
Figure 8A:
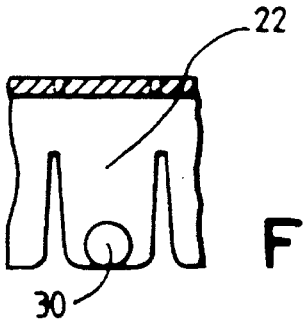
FIG. 8A illustrates a sectional view along line 8A—8A of FIG. 4

As shown in detail on FIGS. 8A and 8B, lugs 22 also have several projections such as a projection 30 on their internal surface having a form of a portion of a hemisphere. Projection 30 is designed to exert a pressure on the back of coil 25 in order to hold coil 25 firmly in contact with separator body 26. Similar symbols and numerals in FIGS. 1–5, 8A and 8B indicate similar items or functions. Lugs 22 of FIGS. 3 and 4 are uniformly distributed around the periphery of part 20. For example, six lugs 22 are uniformly distributed every 60°.

In order to support core 5' of FIG. 4 made of magnetic material, rear part 20 of the separator is provided with arms 21 placed around its periphery and extending towards the front of the separator. The length of these arms is such that they either come into contact with or slightly displaced from core 5' of FIG. 3 to take into account tolerances for the length of said core 5' when core 5' is installed. There are four arms 21 of FIG. 4 that prevent core 5' of FIG. 3 from tilting. Thus, core 5' is held in place by four arms 21 uniformly distributed at 90° angular intervals around the external periphery of rear part 20.

Figure 7A:
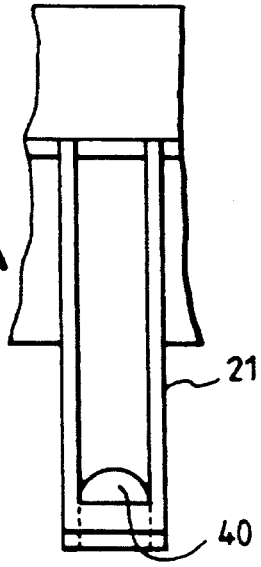
FIG. 7A illustrates a front view and FIG. 7B illustrates a sectional view along line 7B—7B of FIG. 4 of an arrangement for maintaining the core of FIG. 3 in position.
Figure 7B:
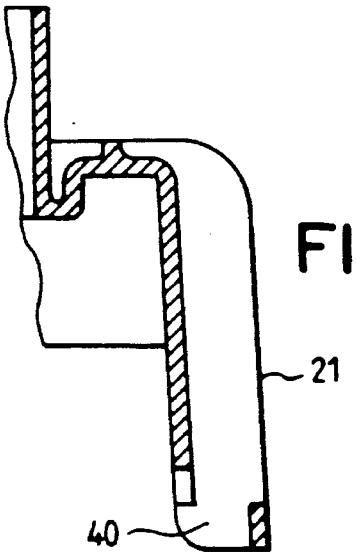

As a compromise between the material weight and the mechanical stiffness of arms 21, arms 21 may be U-shaped as shown in FIG. 6 showing a longitudinal section of rear part 20 of the separator. A gluing operation between tips of arms 21 and core 5' of FIG. 3 may be possible in order to hold core 5' in place. As shown in FIG. 6, and in more detail in FIGS. 7A and 7B, the end of a given arm 21 has an opening 40 designed to allow a flow of glue in order to attach the end of arm 21 to the back of core 5'. Similar symbols and numerals in FIGS. 1–6, 7A, 7B, 8A and 8B indicate similar items or functions. The U-shape form assists in guiding the flow of glue towards opening 40 of arm 21 of FIGS. 7A and 7B that is close to core 5' of FIG. 3.

The deflection yoke is attached to the tube neck by a clamp collar 24 of FIG. 3 placed around flexible lugs 23. As shown in FIG. 5, a given lug 23 is made flexible at an attachment 50 that attaches lug 23 to an internal periphery of rear part 20. Each attachment 50 is S-shaped.

After the position along the Z-axis is established by tightening clamp collar 24, the deflection yoke frequently has to be tilted in the XZ plane and/or the YZ plane in order to optimize the positioning of the deflection field axes with respect to the electron gun axis and the main Z-axis of the tube. S-shaping of attachment 50 provides an advantage when aligning the deflection yoke on the tube neck. Advantageously, attachment 50 absorbs stresses caused by tilting the deflection yoke without transferring the stress to lugs 23. This prevents any change to the Z position of the deflection yoke during the final adjustment of its position on the tube neck.

What is claimed is:

1. A deflection yoke for a cathode ray tube, comprising:

a horizontal deflection coil;

a saddle-shaped vertical deflection coil separated from the horizontal deflection coil;

a truncated cone-shaped core made of magnetic material placed around at least one of said deflection coils; and a separator for separating said horizontal and vertical deflection coils, said separator including:

a funnel-shaped main body; and a removable rear ring having a locking attachment arrangement for selectively attaching said main body to said removable ring when said deflection yoke is assembled and a second attachment arrangement for attaching said rear ring to the tube neck.

2. A deflection yoke according to claim 1, wherein said second attachment arrangement includes flexible lugs attached to said rear ring and extending along a longitudinal axis of the tube.

3. A deflection yoke according to claim 2, wherein each of said flexible lugs includes an S-shaped portion.

4. A deflection yoke according to claims 1, wherein said locking attachment includes a plurality of studs placed on a rear part of said main body that cooperates with flexible pawls firmly attached to the rear ring.

5. A deflection yoke according to claim 4, wherein said studs are placed on an inside surface of said main body.

6. A deflection yoke for a cathode ray tube, comprising:

a horizontal deflection coil;

a saddle-shaped vertical deflection coil separated from the horizontal deflection coil;

a truncated cone-shaped core made of magnetic material placed around at least one of said deflection coils; and a separator for separating said horizontal and vertical deflection coils, said separator including:

a funnel-shaped main body; and a removable rear ring having a locking attachment arrangement for selectively attaching said main body to said removable ring when said deflection yoke is assembled, said removable rear ring having arms placed on a periphery of said rear ring such that, when said rear ring and said main body of said separator are attached to each other, said arms extend toward a front part of said separator for securing said core.

7. A deflection yoke according to claim 6, wherein said rear ring includes four of said arms.

8. A deflection yoke according to claim 6, wherein said arms are U-shaped.

9. A deflection yoke according to claim 6, wherein each of said arm has an opening at its end.

10. A deflection yoke for a cathode ray tube, comprising:

a horizontal deflection coil;

a saddle-shaped vertical deflection coil separated from the horizontal deflection coil;

a truncated cone-shaped core made of magnetic material placed around at least one of said deflection coils; and a separator for separating said horizontal and vertical deflection coils, said separator including:

a funnel-shaped main body; and a removable rear ring having a locking attachment arrangement for selectively attaching said main body to said removable ring when said deflection yoke is assembled, said removable rear ring having flexible lugs around its periphery that extend around a rear part of said vertical deflection coils for securing said vertical deflection coils.

11. A deflection yoke according to claim 10, wherein each flexible lug has a protuberance that is in contact with the rear part of said vertical deflection coil.

* * * * *